US009771913B2

(12) United States Patent
Schmidt et al.

(10) Patent No.: US 9,771,913 B2
(45) Date of Patent: Sep. 26, 2017

(54) METHOD FOR ACTUATING A STARTING DEVICE FOR AN INTERNAL COMBUSTION ENGINE

(71) Applicant: Robert Bosch GmbH, Stuttgart (DE)

(72) Inventors: Karl-Otto Schmidt, Keltern (DE); Josef Weigt, Vaihingen (DE); Stefan Tumback, Stuttgart (DE); Birgit Kuettner, Sersheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/408,795

(22) PCT Filed: May 15, 2013

(86) PCT No.: PCT/EP2013/060023
§ 371 (c)(1),
(2) Date: Dec. 17, 2014

(87) PCT Pub. No.: WO2013/189666
PCT Pub. Date: Dec. 27, 2013

(65) Prior Publication Data

US 2015/0167616 A1 Jun. 18, 2015

(30) Foreign Application Priority Data

Jun. 21, 2012 (DE) ..... 10 2012 210 520

(51) Int. Cl.
*F02N 11/08* (2006.01)
*F02N 15/06* (2006.01)
*H01H 51/06* (2006.01)

(52) U.S. Cl.
CPC ..... *F02N 11/0851* (2013.01); *F02N 11/087* (2013.01); *F02N 11/0855* (2013.01);
(Continued)

(58) Field of Classification Search
CPC ..... F02N 11/0855; F02N 11/0844; F02N 2200/022; F02N 15/067; F02N 2200/048;
(Continued)

(56) References Cited

U.S. PATENT DOCUMENTS 3,275,964 A 9/1966 Kumm
3,757,611 A 9/1973 Buck
(Continued)

FOREIGN PATENT DOCUMENTS

CN 102472236 A 5/2012
DE 102005021227 11/2006
(Continued)

OTHER PUBLICATIONS

International Search Report for Application No. PCT/EP2013/060023 dated Sep. 19, 2013 (English Translation, 2 pages).

*Primary Examiner* — Sizo Vilakazi
(74) *Attorney, Agent, or Firm* — Michael Best & Friedrich LLP

(57) ABSTRACT

In a method for actuating a starting device for an internal combustion engine, for the case in which the rotational speed of the toothed ring is below a limit value, first a stroke armature in a starter relay is moved and an electric starter motor is switched on after the starter pinion has engaged. If the rotational speed of the toothed ring exceeds the limit value, the starter motor is switched on before the starter pinion contacts the toothed ring.

11 Claims, 4 Drawing Sheets

(52) U.S. Cl.
CPC ..... *F02N 15/062* (2013.01); *F02N 15/066* (2013.01); *F02N 15/067* (2013.01); *F02N 2200/022* (2013.01); *H01H 51/065* (2013.01)

(58) Field of Classification Search
CPC .... F02N 11/0814; F02N 11/087; F02N 11/08; F02N 11/0851; Y02T 10/48
USPC ..... 123/179.25, 179.3, 179.4; 290/38 R, 290/38 C, 38 E; 701/112, 113
See application file for complete search history.

(56) References Cited

U.S. PATENT DOCUMENTS

| | | | | |
|---|---|---|---|---|
| 4,755,689 | A * | 7/1988 | Porter | F02N 11/0851 123/179.1 |
| 5,422,617 | A | 6/1995 | Brown | |
| 5,892,422 | A | 4/1999 | Montaigu et al. | |
| 6,677,844 | B1 | 1/2004 | Gorospe et al. | |
| 6,823,757 | B2 | 11/2004 | Kobayashi | |
| 7,965,161 | B2 | 6/2011 | Roche | |
| 7,982,565 | B2 | 7/2011 | Bradfield et al. | |
| 8,171,908 | B2 * | 5/2012 | Senda | F02N 11/0844 123/179.4 |
| 8,289,110 | B2 | 10/2012 | Niimi et al. | |
| 2007/0137602 | A1 * | 6/2007 | Kassner | F02N 11/0844 123/179.25 |
| 2008/0127927 | A1 * | 6/2008 | Hirning | F02N 11/0855 123/179.3 |
| 2010/0033066 | A1 | 2/2010 | Murata et al. | |
| 2010/0050970 | A1 * | 3/2010 | Okumoto | F02N 11/0844 123/179.4 |
| 2010/0251852 | A1 | 10/2010 | Murata et al. | |
| 2011/0095852 | A1 | 4/2011 | Niimi et al. | |
| 2011/0137544 | A1 | 6/2011 | Kawazu et al. | |
| 2011/0184626 | A1 * | 7/2011 | Mauritz | F02N 11/0855 701/102 |
| 2012/0029797 | A1 * | 2/2012 | Notani | F02N 11/0844 701/113 |
| 2012/0271537 | A1 * | 10/2012 | Okabe | F02D 11/10 701/112 |

FOREIGN PATENT DOCUMENTS

| | | | |
|---|---|---|---|
| DE | 102008042946 | | 4/2010 |
| DE | 102009027117 | | 12/2010 |
| DE | 102010001773 | | 8/2011 |
| JP | 2011144797 | A | 7/2011 |
| JP | 2011214535 | A | 10/2011 |
| JP | 2011220144 | A | 11/2011 |
| WO | 2012008045 | A1 | 1/2012 |
| WO | 2012069293 | | 5/2012 |

* cited by examiner

METHOD FOR ACTUATING A STARTING DEVICE FOR AN INTERNAL COMBUSTION ENGINE

BACKGROUND OF THE INVENTION

The invention relates to a method for actuating a starting device for an internal combustion engine.

The German patent application DE 10 2009 027 117 A1 discloses a starting device comprising an electromagnetic starter relay which has two separate axially successively arranged relay windings in one housing. The first relay winding performs the task of a pull-in winding and moves a stroke armature which is coupled via an engagement lever to a starter pinion of the starting device. When the pull-in winding is energized, the starter pinion is moved between a retracted inoperative position and an axially advanced engaged position in which the starter pinion engages with a toothed ring of the internal combustion engine. The second relay winding serves as a switching winding and is paired with a switching means via which the power circuit of an electric starter motor for driving the starter pinion is to be switched on or off. A switching armature is paired with the switching winding, said switching armature, when current is passed through the switch-on winding, pressing a contact plate against two opposing contacts for closing the power circuit of the starter motor.

The embodiment comprising two separate relay windings allows the decoupling of the pre-meshing movement of the starter pinion from the switching-on of the electric starter motor.

SUMMARY OF THE INVENTION

The underlying aim of the invention is to enable a reliable, low-noise starting of an internal combustion engine under different operating conditions by the use of a starting device. Said aim is also to include operating states in which engagement is to be made into a decelerating toothed ring.

The method relates to a starting device for an internal combustion engine comprising an electromagnetic starter relay, by means of which a starter pinion of the starting device can be adjusted between a retracted inoperative position and an advanced engaged position with a toothed ring or the internal combustion engine. The adjusting movement of the starter pinion preferably relates to an axial adjusting movement, wherein pivoting movements come also in principle into consideration. The starter relay comprises an energizable pull-in winding, with which a stroke armature is paired that is displaced when current is passed through the pull-in winding. The adjusting movement of the stroke armature is transmitted to the starter pinion with the aid of a transmission component, for example a fork lever, said starter pinion thereupon being moved from the inoperative position into the engaged position.

The starting device furthermore comprises an electric starter motor, which sets the starter pinion into a rotating drive motion. The starter motor is switched on or off via a switch-on device, which is preferably integrated into the starter relay. By activating the switch-on device, the power circuit of the electric starter motor is closed and the starter motor is set into rotation. The switch-on device can thereby be actuated independently of the stroke armature or the energization of the pull-in winding.

In the method, different operating states of the internal combustion engine or more precisely the toothed ring of the internal combustion engine are differentiated. Said differentiation is made via the current rotational speed of the toothed ring at the point in time when the starting device is switched on, by means of which starting device the internal combustion engine is to be started. If the current rotational speed of the toothed ring is below a limit value, only the stroke armature is initially moved; and the switch-on device is switched on and thereby the starter motor as well as the starter pinion is set into rotation only after the starter pinion contacts the toothed ring of the internal combustion engine.

If, on the other hand, the toothed ring has a relatively high rotational speed and the rotational speed of said toothed ring exceeds a limit value, the switch-on device is thus already switched on prior to the starter pinion making contact with the toothed ring and as a result the rotational speed of the starter pinion is increased.

In this way, all of the operating conditions that occur can basically be covered under which the internal combustion is to be started by means of the starting device, wherein the starting of the internal combustion engine involves a smaller component load as well a reduced noise emission. Starting operations can be repeatedly carried out, in particular over a long operating period, during which operations the starter pinion has to be engaged and started in a still rotating toothed ring of the internal combustion engine, which, e.g., can occur in start-stop systems where the internal combustion system is frequently turned off and on. With regard to the differentiation via the rotational speed of the toothed ring, two different basic situations can be differentiated which are treated differently in each case.

If the rotational speed of the toothed ring undershoots the limit value, the pre-meshing or engagement of the starter pinion, i.e. the adjusting movement of said starter pinion from the inoperative position into the engaged position, occurs first and subsequently the cranking of the engine via the electric starter motor. Normal or regular staring operations are included in these cases, in which the internal combustion engine and the toothed ring are stationary, i.e. the rotational speed of the toothed ring is equal to zero, as well as operating situations having a relatively low rotational speed of the toothed ring. For the case in which the toothed ring is stationary, the starter pinion can move into a tooth-to-tooth position with the toothed ring during the pre-mesh operation. Said tooth-to-tooth position is however released when the starter pinion is set into rotation by switching on the starter motor. If, however, the toothed ring has a rotational speed below the limit rotational speed, tooth-to-tooth positions between the starter pinion and the toothed ring are also released solely due to the rotational speed of the toothed ring. In this case, it can be useful to carry out the starting operation by means of switching on the starter motor in a slightly delayed manner in relation to the situation in which the toothed ring is stationary.

If, on the other hand, the rotational speed of the toothed ring exceeds the limit value, a relatively high rotational speed of the toothed ring exists, wherein the rotational speed of the starter pinion is increased by switching on the starter motor and synchronization between starter pinion and toothed ring is achieved. In this instance, it is, in principle, sufficient if the rotational speed of the starter pinion is raised as a maximum to the level of the rotational speed of the toothed ring at the moment of engagement, wherein, in some instances, a slightly lower level of rotational speed of the starter pinion is sufficient, for example a rotational speed of the starter pinion that is reduced by 5% or 10% with respect to the rotational speed of the toothed ring. By the rotational speed of the starter pinion being raised to a level which does not exceed the rotational speed of the toothed ring, undesirable load shocks in the drive train of the starting device between the electric starter motor, a planetary gear set that is possibly provided, a freewheel that is possibly provided and the starter pinion are prevented.

Due to the inertia of the internal combustion engine, the toothed ring can overshoot in the opposite direction. In the event that the internal combustion engine is to be started again in this situation, the starter pinion is initially pre-meshed by moving the stroke armature in the starter relay, and the switch-on device of the starter motor is switched on only after the starter pinion has engaged. It can however be advantageous to switch on the starter motor with a greater time delay in comparison to a switch-on process when the combustion engine is stationary or the rotational speed of the toothed ring is slightly positive. This is done in order to reduce the load shock in the drive train by an additional torque being avoided which would be added upon start-up of the starter motor.

Because, during a normal starting operation, the pinion cannot be meshed with the stationary toothed ring when a tooth-to-tooth position exists, the starter must be switched on before the pinion is meshed with the toothed ring. When meshing with the backward-rotating toothed ring—backward meshing—the starter motor is first started after the pinion has engaged with the toothed ring.

It is however also possible in principle, during a starting operation in which the toothed ring is stationary as well as in which the toothed ring rotational speed is below the limit value, to actuate the switch-on device and thereby start the starter motor if a tooth-to-tooth position with the toothed ring exists as a result of pre-meshing the starter pinion. If the starter pinion is already set into rotation in the tooth-to-tooth position, the engagement operation can be supported in which the toothing of the starter pinion and that of the toothed ring mesh with each other.

According to an advantageous embodiment, the switch-on device can comprise an additional winding in the starter relay which assumes the function of an energizable switching winding, wherein an axially adjustable switching armature is paired with the switching winding. The switching armature is moved into a contact position when current is passed through the switching winding, whereby the power circuit of the starter motor is closed. Current is passed through the switching winding basically independently of current being passed through the pull-in winding, which serves to move the starter pinion between the inoperative and engaged position.

With regard to the starting operation, in particular at high engine rotational speeds, it can be useful to predict the rotational speed of the toothed ring at the expected point in time of the engagement operation in order to base the decision for the execution of the entire operation thereupon.

BRIEF DESCRIPTION OF THE DRAWINGS

Further advantages and useful embodiments can be extracted from the further claims, the description of the figures and the drawings. In the drawings:

DETAILED DESCRIPTION

Figure 1:
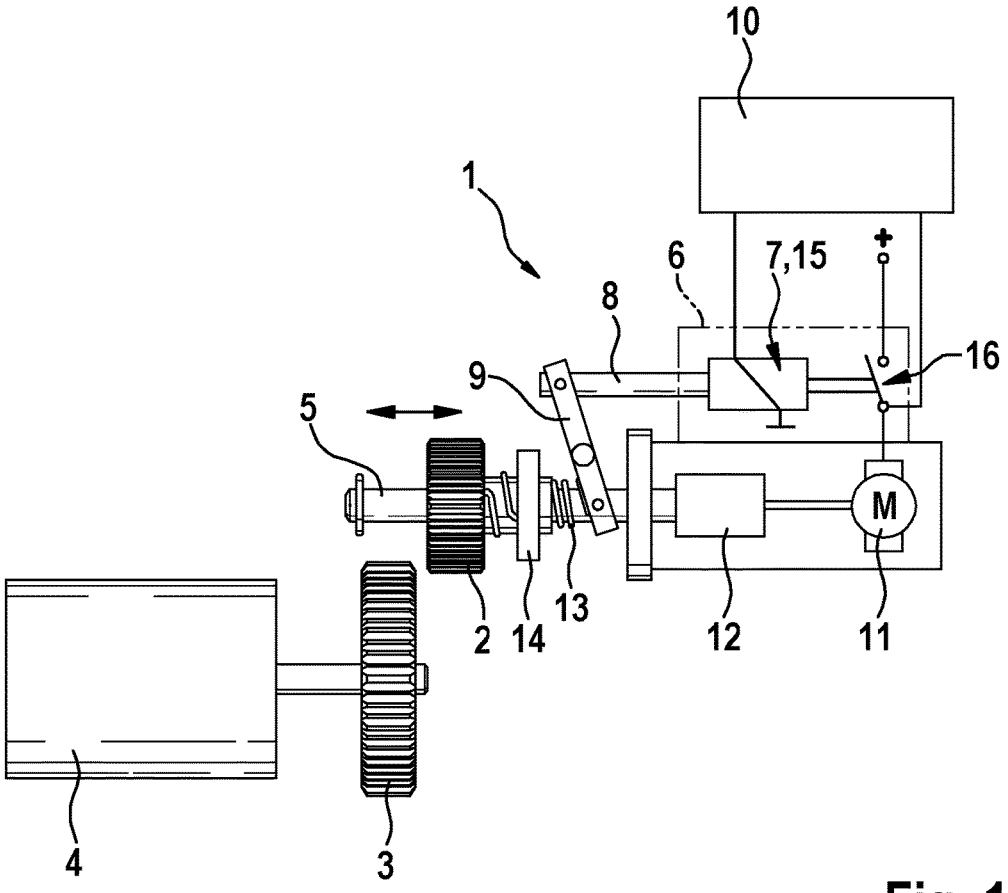
FIG. 1 shows a starting device for an internal combustion engine comprising a starter pinion which can be adjusted axially by means of a starter relay and is rotationally driven by means of an electric starter motor, wherein the electric starter motor is switched on via a switch-on device in the starter relay.

Identical components are provided with the same reference numerals in the figures.

The starting device 1 for an internal combustion engine depicted in FIG. 1 comprises a starter pinion 2 which is brought into engagement with a toothed ring 3 of the internal combustion engine. The starter pinion 2 is mounted on a shaft 5 in an axially displaceable manner as is indicated by the double arrow, said starter pinion 2 being coupled to the shaft 5 in a rotationally fixed manner. The starter pinion 2 is moved by a starter relay 6 between a retracted inoperative position and an advanced engaged position with the toothed ring 3 of the internal combustion engine 4, said starter relay being electromagnetically designed and comprising two energizable relay windings 7, 15 as well as a stroke armature 8 which, upon current being passed through the first relay winding 7 that has the function of a pull-in winding, is axially pulled into the same. The stroke armature 8 actuates an engagement lever 9 which acts upon an engagement spring 13 that rests on a driver 14 of a roll free wheel. The starter pinion 2 is coupled to the driver 14 on the output side; thus enabling the axial feed movement of the driver 14 to be converted into the desired axial adjusting movement of the starter pinion 2 between the inoperative position and the engaged position.

The rotating drive motion transmitted onto the shaft 5 or the starter pinion 2 is generated with the aid of an electric starter motor 11 which is coupled via a transmission 12, for example a planetary gear set, to the shaft 5. Upon actuating the electric starter motor 11, the shaft 5 and therefore the starter pinion 2 are set into rotation.

The starter motor 11 is switched on by means of a switch-on device 16 which is integrated into the starter relay 6. The power circuit is closed in the switch-on device 16 by means of a switching member that is embodied as a switching armature and is moved when current is passed through the second relay winding 15 that serves the function of a switching winding. When the power circuit is closed, the starter motor 11 is set into motion and the shaft 5 as well as the starter pinion 2 is rotationally driven.

A regulation or control device 10 is paired with the starting device 1, the functions of the starter relay as well as the starter motor being controlled via said regulation or control device. It is particularly possible for the energization of the pull-in winding 7 and the switching winding 15 to be carried out independently of one another.

Figure 2:
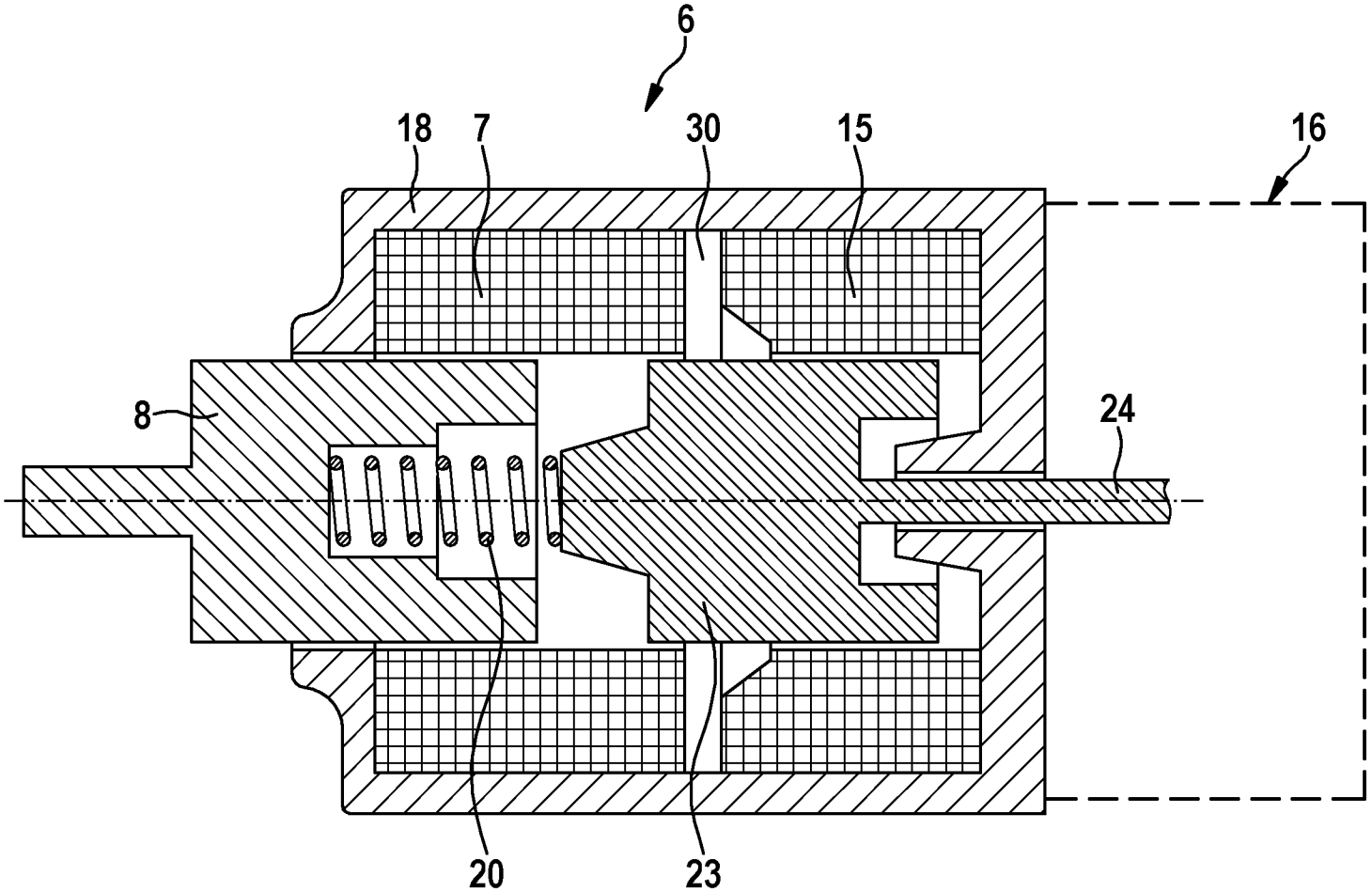
FIG. 2 shows a cross section through a starter relay comprising an integrated switch-on device.

A starter relay is depicted in longitudinal cross section in FIG. 2. The starter relay 6 comprises two relay windings 7, 15 which are disposed in an axially successive manner in the housing 18, wherein an air gap 30 lies between the relay windings 7, 15. The first relay winding 7 serves as a pull-in winding for axially adjusting the stroke armature 8 which induces the adjusting movement of the starter pinion. The second relay winding 15 is paired with a switch-on device 16 for starting the electric starter motor and, when energized, adjusts the switching armature 23 which, in the initial position thereof, is advantageously subjected to a force of a switching armature return spring. When current is passed through the switching winding 15, the switching armature 23 is moved against the force of the switching armature return spring, whereby the power circuit is closed.

The stroke armature return spring 20 which applies a force to the stroke armature 8 in the initial position of said armature, is supported on the side facing away from the stroke armature 8 at the end face of the switching armature 23. The stroke armature 8 together with the switching armature 23 and a portion of the housing 18 forms an electromagnetic circuit.

The switch-on device 16 for switching on or off the electric starter motor is integrated into the starter relay 6 or is disposed on said relay 6 and is fixedly connected to the housing 18. The switch-on device 16 comprises the switching armature 23, which, when current is passed through the associated switching winding 15, is moved out of the initial position axially into a contact position in which a contact bridge on a switching plunger 24, which is connected to the switching armature 23, comes into electrical contact with two opposing contacts that lie in the power circuit of the electrical starter motor, whereby the power circuit is closed and the electric starter motor is started.

The pull-in winding 7 and the switching winding 15 are energized, in principle, independently of one another. This facilitates the use of different procedural approaches which are carried out respectively in accordance with the current operating state. In particular, engagement operations are possible into a toothed ring of the internal combustion engine that is still rotating, for example during a restart shortly after switching off the internal combustion engine when the starter pinion has to be meshed into the decelerating toothed ring.

Figure 3:
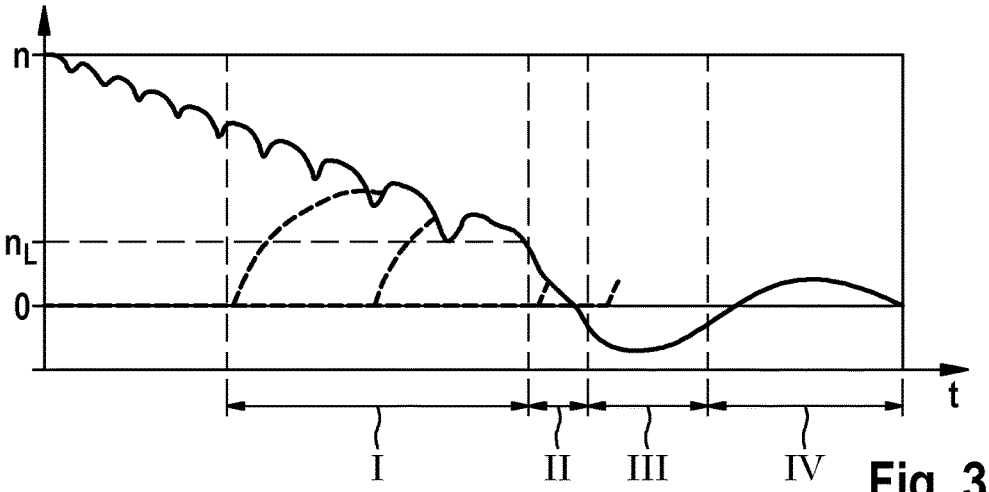
FIG. 3 shows a diagram comprising the temporally dependent course of the rotational speed of the toothed ring after the internal combustion engine has been switched off, comprising additionally the plotted course of the rotational speed of the starter pinion at different switch-on points in time.

In FIG. 3, the temporally dependent course of the rotational speed of the toothed ring (solid line) after switching off the internal combustion engine is depicted. The rotational speed of the toothed ring drops in a sawtooth-shaped manner and undershoots the zero level on account of the inertia of the internal combustion engine. The rotational speed of the toothed ring therefore overshoots in the opposite direction and subsequently again exceeds the zero level and fades away thereafter. A limit value $n_L$ can be defined for the rotational speed of the toothed ring, wherein, in the case of the current rotational speed of the toothed ring being exceeded or undershot, different starting procedures can be carried out via the starting device.

By way of example, the starting operation is divided into four different phases I, II, III and IV. In the phases I, II, IV, the toothed ring has a positive rotational speed. In phase III, the toothed ring overshoots in contrast in the opposite direction and therefore has a negative rotational speed. In the first phase I, the rotational speed of the starter lies above the limit value $n_L$. If the internal combustion engine is to be started in phase I, the electric starter motor is thus set into rotation by passing current through the switching winding 15 and the rotational speed of the starter pinion, as is depicted with a dotted line, is thereby raised to a level which is advantageously approximately as high as the rotational speed of the toothed ring at the moment of engagement. The rotational speed of the starter pinion advantageously does not exceed the rotational speed of the toothed ring at the moment of engagement but is maximally at the same level or if need be slightly below said level, for example by 5% or 10%, in order to prevent a load shock in the drive train of the starting device. In phase I, current is initially passed through the switching winding 15 in order to start the electric starter motor; current is subsequently passed through the pull-in winding 7 in order to engage the starter pinion with the toothed ring.

In phase II, the rotational speed of the toothed ring lies below the limit value $n_L$, said speed is however greater than zero. In the run-out phase, the rotational speed of the starter pinion also ranges at a level between zero and the limit value $n_L$. In both phases I and IV, the starting operation takes place by only initially passing current through the pull-in winding 7; and as a result, the stroke armature 8 is moved in order to engage the starter pinion with the toothed ring. After the starter pinion has engaged, the switch-on device 16 is switched on by passing current through the switching winding 15, and the power circuit of the electric starter motor is closed.

In phase III, the toothed ring overshoots in the opposite direction on account of the inertia of the internal combustion engine. Current is also initially passed through the pull-in winding in this phase up until the starter pinion has engaged with the toothed ring, and current is subsequently passed through the switching winding 15 in order to switch on the switch-on device 16. The time lag between the switch-on time for supplying current to the pull-in winding 7 and the energization of the switching winding 15 is however greater than in the phases II and IV. The load shock in the drive train is intended to be reduced by means of the greater time lag.

The temporally dependent profiles of the current flow to the pull-in winding 7 (solid line course) and to the switching winding 15 (dot and dash line course) are depicted in each case in FIGS. 4 to 11.

Figure 4:
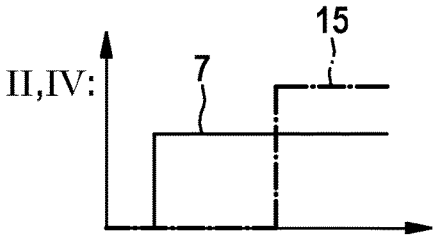
FIG. 4 shows the temporally dependent current profile for supplying current to the pull-in winding (solid line) and to the switching winding (dotdashed line)

FIG. 4 characterizes the current profile for the phases II and IV from FIG. 3. Current is initially passed through the pull-in winding 7, current is passed through the switching winding 15 after a time lag.

Figure 5:
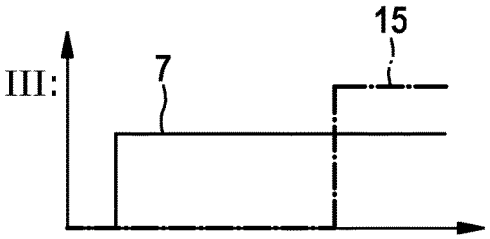
FIGS. 5 to 11 further circuit diagrams comprising the current profiles for the pull-in winding and the switching winding, which are used in different operating situations for starting the internal combustion engine via the starting device.

In FIG. 5, the current profile for phase III is depicted, which characterizes the starting operation when the rotational speed of the toothed ring overshoots in the opposite direction. In this case, current is also initially passed through the pull-in winding 7 and subsequently through the switching winding 15, wherein the time lag between the switch-on times is greater than in phases II and IV (depicted in FIG. 4).

Figure 6:
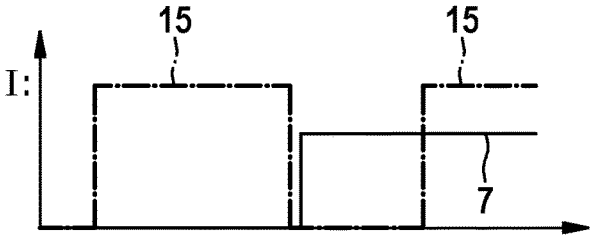

The current profile for phase I is depicted in FIG. 6 in which the rotational speed of the toothed ring exceeds the limit value $n_L$. Current is initially passed through the switching winding 15 and the starter motor is thereby started, whereby the rotational speed of the starter pinion is raised to a level which preferably does not exceed the rotational speed of the toothed ring at the moment of engagement. The switching winding 15 is again switched off, immediately thereafter current is passed through the pull-in winding 7 in order to pre-mesh the starter pinion between the inoperative and the engagement position. After a time lag, current is resupplied to the switching winding in order to rotationally drive the engaged starter pinion; the pull-in winding 7 remains energized. The advantage of the procedural approach depicted in FIG. 6 is that the impact load at the moment of engagement of the starter pinion with the toothed ring is smaller due to the dropping acceleration. In addition, the full battery voltage is available for the pre-mesh operation of the starter pinion.

Figure 7:
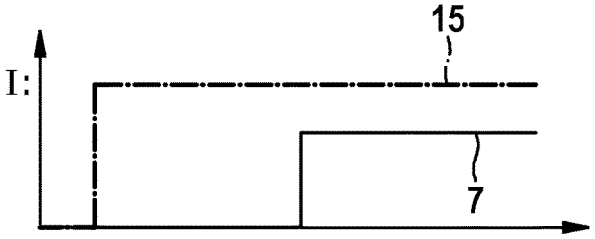

An alternative to the current flow profile in phase I is depicted in FIG. 7. In contrast to FIG. 6, the current supply to the switching winding 15 is not interrupted during the starting operation but is maintained. This has the advantage that the starting operation can be carried out faster because no time is lost due to switching off the starter. In addition, the demands placed on the switching precision of the switching armature 23 are less. The stroke armature 8 must furthermore only overcome the force of the engagement spring 13 in a tooth-to-tooth position.

Figure 8:
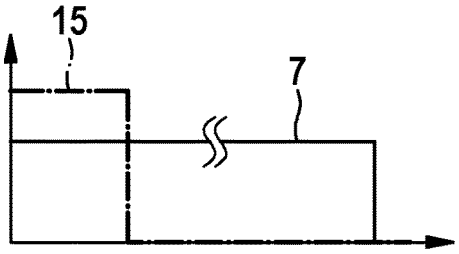
Figure 9:
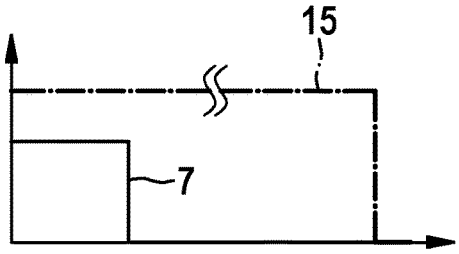

In FIGS. 8 and 9, the current flow variants for continuing a starting operation that has already begun are depicted. Pursuant to FIG. 8, the switching winding 15 is deactivated after a defined time period has elapsed, whereas current continues to pass through the pull-in winding 7. Pursuant to FIG. 9, the pull-in winding 7 is deactivated after a defined time period has elapsed, whereas current continues to pass through the switching winding 15.

Figure 10:
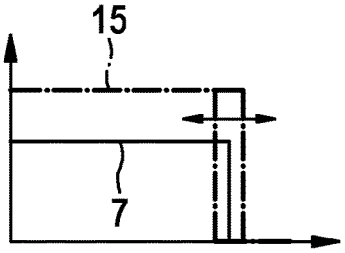
Figure 11:
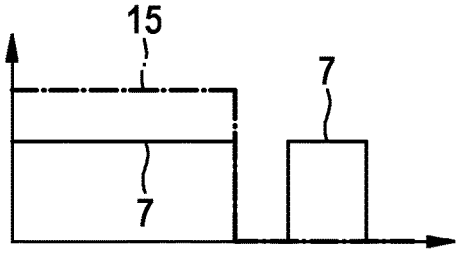

FIG. 10 shows the current profile at the end of the starting operation. The current supply to the pull-in winding 7 and to the switching winding 15 is switched off, wherein the point in time when current is switched off to the switching winding 15, as is indicated by the double arrow, is advantageously in the proximity of the point in time when current is switched off to the pull-in winding, can however, in principle, vary slightly, i.e. can be set before or after the point in time for switching off current to the pull-in winding 7. Due to the return springs in the starter relay, the stroke armature 8 as well as the switching armature 23 is moved back into the initial or resting position thereof In FIG. 11, the current profile is depicted in the case of an aborted starting operation due to a blocked toothed ring. In order to deactivate and disengage the starter pinion, the pull-in winding 7 and the switching winding 15 are deactivated at the same point in time. The stroke armature is therefore returned to the initial position thereof due to the force of the stroke armature return spring 20.

In order to also move the switching armature 23 reliably into the resting or initial position thereof or in order to apply an increased force for separating the switching device, current is again passed through the pull-in winding 7 for a short time. The magnetic force between the armatures pulls the switching armature reliably back into the resting position thereof, whereby the electrical contact in addition to the force of the return spring, which acts on the switching armature 23, is interrupted. This function can, for example, be implemented with a starter relay in which the switching armature of the starter relay forms the core plate of the stroke armature.

What is claimed is:

1. A method for actuating a starting device for an internal combustion engine, wherein the starting device includes a starter relay (6) that includes a stroke armature (8), an energizable pull-in winding (7) for moving the stroke armature (8), a switching armature (23), and an energizable switching winding (15) for moving the switching armature (23), and further includes a switch-on device (16) for switching on an electric starter motor (11) through movement of the switching armature (23) away from the pull-in winding (7) in response to energization of the switching winding (15), wherein the switching winding (15) can be energized independently of the pull-in winding (7), wherein, in a starting operation in which the internal combustion engine is started by rotation of a starter pinion by the starter motor (11), the starter pinion being engaged with a toothed ring (3) of the internal combustion engine (4) by movement of the stroke armature (8), for a case in which a rotational speed of the toothed ring (3) is below a limit value ($n_L$), first only the stroke armature (8) is moved and the switch-on device (16) of the starter motor (11) is switched on only after a starter pinion (2) has engaged with the toothed ring (3), for a case in which the rotational speed of the toothed ring (3) exceeds the limit value ($n_L$), the switch-on device (16) is switched on before the starter pinion (2) contacts the toothed ring (3) of the internal combustion engine (4) in order to increase the rotational speed of said starter pinion (2), and for a case in which a starting operation is aborted due to a blocked toothed ring, the pull-in winding (7) and the switching winding (15) are switched off at the same point in time in order to deactivate and disengage the starter pinion, wherein current is subsequently supplied once again to the pull-in winding (7) to move the switching armature to an initial position.

2. The method according to claim 1, characterized in that, for the case in which the rotational speed of the toothed ring (3) exceeds the limit value ($n_L$), the rotational speed of the starter pinion (2) is increased to a value which is smaller than or equal to the rotational speed of the toothed ring (3).

3. The method according to claim 1, characterized in that, for the case in which the rotational speed of the toothed ring (3) exceeds the limit value ($n_L$), the switch-on device (16) is switched off after which the switch-on device (16) is switched on again after the pull-in winding (7) is energized.

4. The method according to claim 1, wherein for a case in which the toothed ring (3) rotates in an opposite direction, first only the stroke armature (8) is moved and the switch-on device (16) of the starter motor (11) is switched on only after the starter pinion has engaged with the toothed ring.

5. The method according to claim 1, characterized in that, for a case in which the rotational speed of the toothed ring is zero, the switch-on device (16) of the starter motor (11) is switched on on condition of a tooth-to-tooth position between starter pinion (2) and toothed ring (3).

6. The method according to claim 1, characterized in that the switching winding (15) is switched off after a defined time period has elapsed, whereas current continues to be passed through the pull-in winding (7).

7. The method according to claim 1, characterized in that the pull-in winding (7) is switched off after a defined time period has elapsed, whereas current continues to be passed through the switching winding (15).

8. The method according to claim 1, characterized in that current is switched off to the pull-in winding (7) and the switching winding (15) at an end of the starting operation, wherein a point in time whereat the switching winding (15) is switched off is equal to or at least contiguous to a point in time whereat the pull-in winding (7) is switched off.

9. A control device for carrying out the method according to claim 1.

10. A starting device for an internal combustion engine comprising the starter relay (6), the switch-on device (16), and the control device according to claim 9.

11. The method according to claim 4, characterized in that the switch-on device (16) of the starter motor (11) is switched on with a larger time delay than in the case in which the rotational speed of the toothed ring (3) is below the limit value ($n_L$) but is greater than zero.

* * * * *